United States Patent [19]

de Nora et al.

[11] 4,056,449

[45] Nov. 1, 1977

[54] ELECTROWINNING METHOD

[75] Inventors: Vittorio de Nora, Nassau, Bahamas; Antonio Nidola; Giuseppe Bianchi, both of Milan, Italy

[73] Assignee: Diamond Shamrock Technologies S.A., Geneva, Switzerland

[21] Appl. No.: 616,044

[22] Filed: Sept. 23, 1975

[30] Foreign Application Priority Data

Oct. 31, 1974 Italy ..... 29067/74

[51] Int. Cl. ..... C25b 1/04; C25c 1/06; C25C 1/12; C25C 1/16

[52] U.S. Cl. ..... 204/106; 204/105 R; 204/108; 204/112; 204/114; 204/274; 204/129

[58] Field of Search ..... 204/262, 274, 290 F, 204/96, 83, 106-108, 112-113, 114-119, 105 R, 129

[56] References Cited

U.S. PATENT DOCUMENTS

| | | | |
|---|---|---|---|
| 3,635,801 | 1/1972 | Bruch | 204/49 |
| 3,751,296 | 8/1973 | Beer | 204/290 F |
| 3,761,364 | 9/1973 | Micheletti | 204/274 |
| 3,772,201 | 11/1973 | Mills | 204/274 |
| 3,775,284 | 11/1973 | Bennett et al. | 204/290 F |
| 3,798,063 | 3/1974 | Decraene | 204/290 F |

OTHER PUBLICATIONS

La Chimica E. L'Industria, XXI, No. 8, 1939, pp. 484-485.

"Electrochemistry of Pf" by A. T. Kuhn, Chemistry & Industry, Oct. 16, 1976, pp. 867-869.

*Primary Examiner*—R. L. Andrews

*Attorney, Agent, or Firm*—Hammond & Littell

[57] ABSTRACT

In the method of electrowinning metals from acid aqueous solutions of the metals, the improvement comprising maintaining the anode surface at a temperature not greater than 40° C to avoid deposits of manganese cobalt and iron dioxides and to improve anode life.

14 Claims, 3 Drawing Figures

ELECTROWINNING METHOD

STATE OF THE ART

Metals such as copper, zinc, cobalt and nickel are often recovered from ores by electrowinning by electrolysis of sulfuric acid solutions obtained by leaching of the ore. However, manganese is often present as an impurity in the sulfuric acid solution and during the electrowinning $MnO_2$ is easily deposited on the anode surface as the anodic potential of 1.2 V for the reaction.

$$Mn^{++} + 2H_2O \rightarrow MnO_2 + 4H^+ + 2e$$

is slightly less than the electrode potential for the main, desired anode reaction for oxygen evolution of 1.24 V by the reaction $$4OH^- \rightarrow O_2 \uparrow + 2H_2O + 4e$$

Due to these very close anode potentials, manganese dioxide deposition occurs in thick layers along with the oxygen evolution.

The porous manganese dioxide coating the active surface does not have any catalytic activity for the evolution of oxygen and therefore, the anode potential rises sharply as the active anode surface is progressively covered and its activity is reduced. This increase is due to the increase of the bubble effect in the pores of $MnO_2$ scale, decrease of the amount of sulfate ions passing into the pores of $MnO_2$ scale necessary for the evolution of oxygen, passivation of the exposed active anode surface at the resulting high current densities and crevice corrosion occuring between the titanium base-porous active coating interface. Similar inconveniences are also experienced when cobalt or iron are present as impurities in the electrolyte and also, during the electrowinning of cobalt sulfate solutions, cobalt oxides precipitate on the active anode surface progressively covering it and decreasing the catalytic activity of the anode.

Another problem occuring in the electrowinning of metals using an anode with a platinum group metal oxide coating such as described in U.S. Pat. No. 3,632,498 and 3,711,385 has been passivation of the anodes at which oxygen is evolved. The anodes with these coatings act to catalyze the evolution of oxygen gas from the oxygen ions at reactive sites on the coating surface. These active sites become blocked by oxygen atoms being absorbed therein and the oxygen overpotential increases. With different anode coatings, other problems are caused by the high temperature of commercial electrowinning baths. For instance, in the case of lead dioxide coatings, the mechanical stability of the coating is jeopardized by the high temperature as the different thermal stresses of the support metal such as titanium and of the coating cause cracking and loss of the lead dioxide coating. Similar problems are experienced also with manganese dioxide coatings and noble metal coatings.

OBJECTS OF THE INVENTION

It is an object of the invention to provide an improved method of electrowinning of metals from sulfuric acid solutions without passivation of the anode by manganese dioxide and iron and cobalt oxide deposition thereon.

It is another object of the invention to provide a novel method of electrowinning of metals without $MnO_2$ iron oxides and cobalt oxides deposition on the anode by maintaining the anode surface at a temperature of less than 40° C.

It is a further object of the invention to provide a method of prolonging anode life in electrolysis reactions involving oxygen evolution.

These and other objects and advantages of the invention will become obvious from the following detailed description.

THE INVENTION

In the novel method of the invention of electrowinning metals from acid aqueous solutions of the metals containing manganese as an impurity by passing an electric current through the said solution to deposit the electrowinned metal at the cathode and to evolve oxygen at the anode, the improvement comprises operating the electrolysis so that the surface of the dimensionally stable anode is below 40° C which substantially prevents deposition of manganese dioxide on the anode surface.

The decrease of the temperature of the anode surface sharply lowers the deposition rate of $MnO_2$. This phenomenon may be due to the following factors: The conversion from the colloidal soluble (sol) form to either colloidal insoluble (gel) or to crystalline form increases with the increase of the temperature and at low temperature, i.e. $<40°$ C, the conversion rate for the reaction.

$$(sol) \rightarrow (gel) \downarrow \text{ (in the soln)}$$

is higher than the conversion rate of the reaction $$(sol) \rightarrow (crystal) \downarrow \text{ (on the anode surface).}$$

As a consequence, the amount of $MnO_2$ which precipitates into the solution as gel is higher than the amount which precipitated on the anode surface as crystal.

The deposition of $MnO_2$ in crystalline form on the anode surface depends both on the formation (nucleation) rate and on the crystal growth. At high temperatures, the crystal growth is high and as a consequence, the deposit is mechanically stable and compact. Conversely, at low temperatures, the formation rate of the $MnO_2$ nuclei is higher than the growth of $MnO_2$ crystals and therefore the precipitates of $MnO_2$ is porous, non-uniform and easily removed both by the anodic gas and by the electrolyte flow around the anode.

The anode surface is cooled below 40° C, preferably below 5° C (at which point) the $MnO_2$ deposition rate appears to be negligible. At temperatures of 15° to 18° C, the deposition rate of $MnO_2$ is approximately 0.05 to 0.1 mg/cm$^2$ per day which is so low that the anodes may be used for long periods of time without passivation. The anodic precipitation of iron oxides and cobalt oxides takes place according to the same mechanism as described for the case of manganese and the effect of lowering the temperature of the anode surface produces the same beneficial effect of hindering the precipitation of these non-conductive deposits mainly represented by CoOx, FeOy etc.

The metals which are commercially electrowinned are well known to the art and the electrolysis can be sulfuric acid solutions of copper, zinc, nickel or cobalt, for example. Other metals may be won by electrolysis of solutions containing the same and other acids may be used but sulfuric acid is the one commercially used to date. The operating conditions such as concentrations, current densities and operating temperatures of the baths are those normally used and will depend upon the usual conditions.

The cooling of the anode surface in the electrowinning of metals from aqueous acid solutions has an advantage even when manganese, cobalt or iron are not present in the electrolyte as an impurities. This advantage is the improved life of metal oxide anode coatings such as those described in U.S. Pat. No. 3,632,498 or U.S. Pat. No. 3,711,385 when the anodes are used for oxygen evolution. Surprisingly, it has been found that the passivation of these anodic coatings under oxygen evolution is noticeable reduced when the anode surface temperature is kept below 40° C.

This prolonged anode life may be explained by the theory that passivation of such coatings under oxygen evolution is due to the fact oxygen atoms progressively fill the vacant active sites in the crystalline structure of the anode coating for catalyzing the evolution of oxygen gas. This results in "oxygen poisoning" of the catalytic coating and apparently the lower anode surface temperature thermodynamically hinders this poisoning process and gives the anodes longer life.

The base or core of the anode may consist of a conductive material which at least on the outside is resistant to the electrolyte in which it is to be used. Thus, for example, the base may consist of any of the film-forming metals, such as aluminum, tantalum, titanium, zirconium, bismuth, tungsten, niobium or alloys of two or more of these metals. However, other conductive base materials which will not be affected by the electrolyte and the products formed during the dissociation thereof may be used. It is possible to use metals such as iron, nickel or lead, and non-metallic conductive materials, such as graphite, in suitable electrolytes.

An electrically conducting electrocatalytic coating is provided on the anode base and the outside portion of the coating layer on the electrode should contain at least one oxide of a metal of the platinum group, i.e. an oxide of a metal taken from the group consisting of platinum, iridium, rhodium, palladium, ruthenium, and osmium, or mixtures of oxides of these metals. The average thickness of the electrocatalytic oxide layer is preferably at least about 0.054 micron.

Alternatively the layer can have the outside portion consisting of a mixture of at least one oxide of such a platinum metal with at least one oxide of a metal other than a platinum metal such as of manganese, lead, chromium, cobalt, and iron. Additions of oxides of film-forming metals such as titanium, tantalum, zirconium, niobium and tungsten can also be used.

The anodes with a mixed oxide material coating are described in U.S. Pat. No. 3,632,498 and the coating is comprised of a valve metal oxide and an oxide of a platinum group metal or gold, silver, iron, nickel, chromium, copper, lead and manganese. Preferably, the coating is a valve metal oxide and platinum group metal oxide such as titanium oxide or tantalum oxide and ruthenium oxide or iridium oxide.

Other types of anodic coatings such as lead dioxide, manganese dioxide coatings and noble metal coatings are also negatively affected either in terms of their catalytic activity or mechanical stability by the high temperature, and the method of the present invention provides a most suitable way of preventing the problems created by the high temperature.

Any suitable means for cooling the anode surface may be used but care should be taken not to drastically effect the operation of the electrowinning process by lowering the temperature of the bulk of the electrolytic bath. One simple means is to make the anode hollow and to pass a cooling liquid such as water or any suitable liquid through the anode during the operation. Conveniently the cooling fluid runs in a closed circuit so that the heat drawn from the anode structure is used to warm fresh electrolyte before it is fed into the cell and the cooling fluid is reduced in temperature by any convenient heat exchanging means.

Referring now to the drawings.

Figure 1:
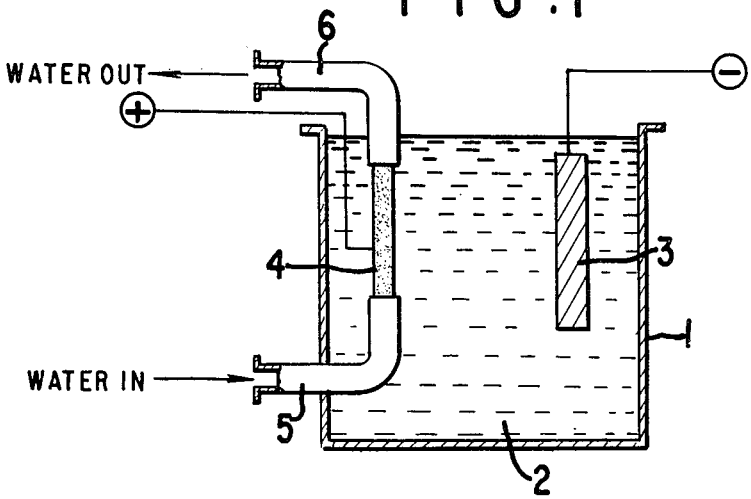
FIG. 1 is a schematic view of one form of cell of the invention using a cooled hollow anode and FIG. 2 is a graph of the results showing the effect of temperature on manganese dioxide deposition.

In FIG. 1, the electrowinning cell is comprised of a container 1 for holding the electrolyte 2, cathode 3 and anode 4 on which an electrical current is impressed. The anode 4 is comprised of a hollow titanium tube provided on its outer surface with a suitable electrocatalytic coating such as platinum group metal or a platinum group metal oxide as described in U.S. Pat. No. 3,711,385 or a mixed crystal material of a valve metal oxide and a non-film forming conductor as described in U.S. Pat. No. 3,632,498. Cooled water is passed through the titanium anode tube 4 by means of inlet pipe 5 and outlet pipe 6.

In the following examples there is described a preferred embodiment to illustrate the invention. However, it should be understood that the invention is not intended to be limited to the specific embodiments described or by any of the theories used to explain the mechanical of the invention.

EXAMPLE 1

In the electrowinning cell of FIG. 1, the titanium tube 4 had a length of 100 mm, an inner diameter of 10 mm, an outer diameter of 11.5 mm and had an outer coating of tantalum oxide and iridium oxide. The electrowinning bath was an aqueous sulfuric acid solution with a pH of 2 containing $CoSO_4$ at 60 to 40 g/liter and a manganese ion content of 4 g/liter. The cobalt electrowinning was effected at a bath bulk temperature of 60° C and a current density of 300 A/m$^2$ and the anode was held at various temperatures measured by thermocouples fixed on the anode surface, by adjusting the flow of cooling water through the anode. The amount of the manganese dioxide deposition in mg/cm$^2$ of anode surface was then plotted against the operation time in hours and the results are reported in FIG. 2. As is shown in FIG. 2 and the following Table, there is substantial manganese dioxide formation on the anode at only 100 hours of operation without anode cooling, but with cooling, there is a dramatic reduction of the deposition with only very minor amounts formed at temperatures below 20° C.

TABLE

Figure 2:
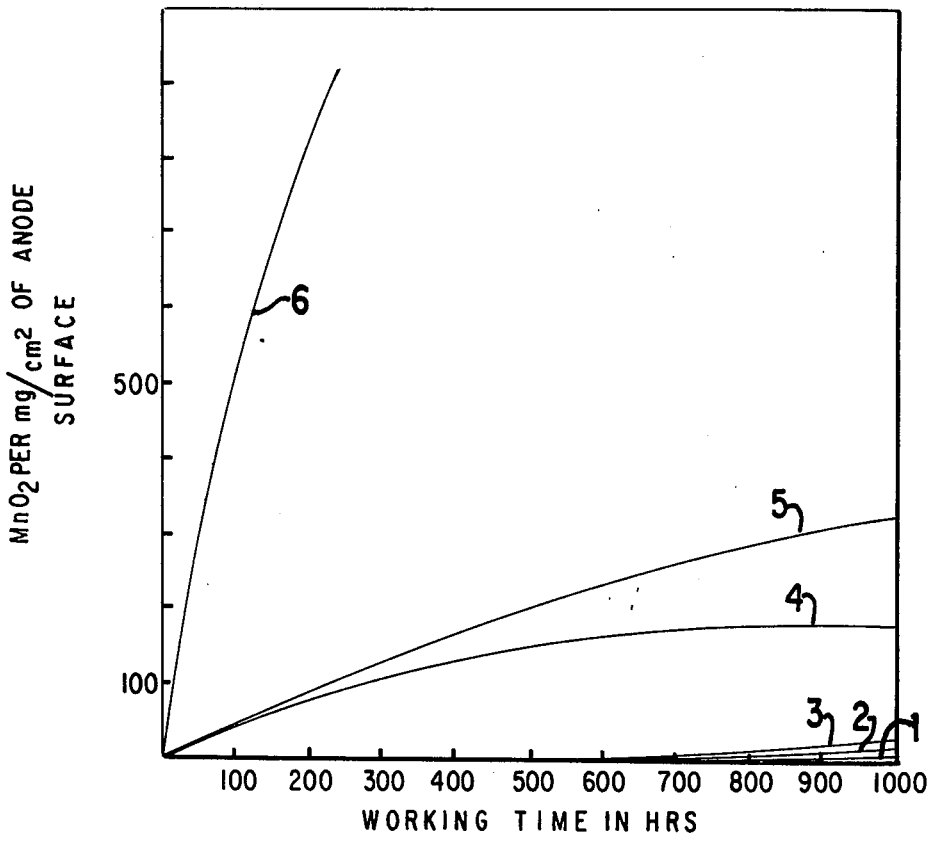

| Line No. in Fig. 2 | Temperature of anode surface |
|---|---|
| 1 | 4 |
| 2 | 15 |
| 3 | 18 |
| 4 | 20 |
| 5 | 40 |
| 6 | 60 |

As is clearly shown, operation of the anode at temperatures below 40° C greatly reduces the rate of $MnO_2$ deposition on the anode surface.

Using the apparatus of FIG. 1 and an anode with an outer coating of a codeposited tantalum oxide-iridium oxide, a 10% sulfuric acid solution was electrolyzed at a bath temperature of 60° C and a current density of 3000 A/m². The anode surface was maintained at the desired temperature by adjusting the flow of cooling water through the titanium tube and temperature readings taken at the anode surface to monitor the temperature of the anode surface.

Figure 3:
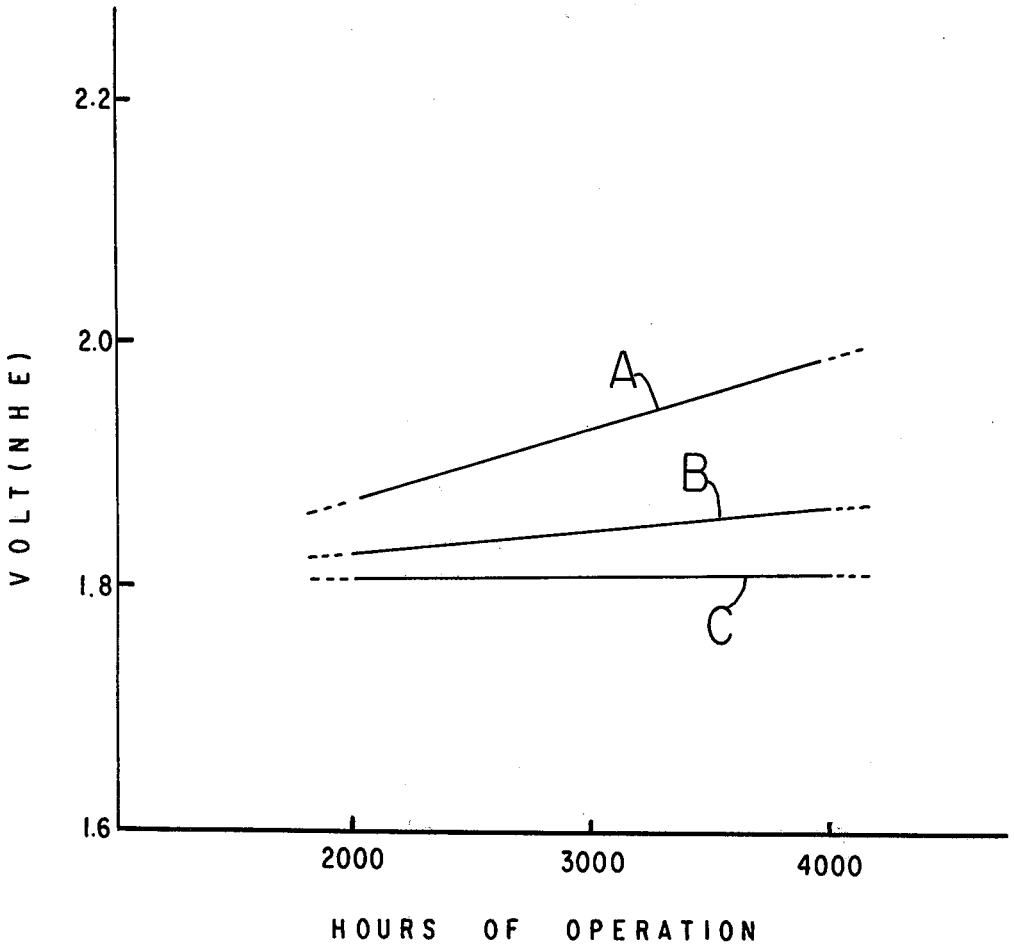
FIG. 3 is a graph illustrating the effect of lowering the anode surface temperature on the coating life under oxygen evolution.

The results have been depicted in the graph of FIG. 3 in which line A illustrates the results for an anode surface temperature of 60° C which is the same as the bulk of the electrolyte bath. Lines B and C illustrates the results for an anode surface temperature of 40° and 20° C, respectively. The graph shows that the oxygen overpotential rapidly increases when the anode surface is not cooled while it increases only a small degree at the lower temperature of 40° C and 20° C.

Various modification of the process and apparatus of the invention may be made without departing from the spirit or scope thereof and it is to be understood that the invention is to be limited only as defined in the appended claims and that the theories given herein and for the purpose of explanation and that the invention is not limited to these theories in the event they are proven to be wrong.

We claim:

1. In a method of evolving oxygen by electrolysis of aqueous solutions by passing an electric current through the solution with oxygen being evolved at the anode, the improvement comprising operating the electrolysis so that the surface temperature of the anode is not greater than 40° C to prevent deposition of an impurity on the anode which increases oxygen overvoltage and causes passivation.

2. The method of claim 1 wherein the temperature of the anode surface is below 20° C.

3. The method of claim 1 wherein the aqueous solution is an acid solution of a metal selected from the group consisting of copper, zinc, nickel and cobalt.

4. The method of electrowinning metals from an aqueous solution wherein oxygen is evolved at the anode in an electrowinning cell comprised of a cell containing at least one anode and at least one cathode and an electrolyte, the improvement comprising cooling the anode surface without decreasing the electrolyte temperature to prevent deposition of an impurity on the anode which increases oxygen overvoltage and causes passivation.

5. The method of claim 4 wherein the anode is hollow and is provided with means for circulating a cooling liquid therethrough.

6. The method of electrowinning in an electrowinning cell containing an aqueous acid solution of the metal to be won, a dimensionally stable anode having an electrically conductive, electrocatalytic coating thereon at which oxygen is released from said solution, a cathode at which the metal to be won is deposited comprising passing an electrolysis current through said cell and maintaining the temperature at the surface of said anode below the temperature of said aqueous solution to prevent deposition of an impurity on the electrocatalytic coating on said anode which increases oxygen overvoltage and causes passivation.

7. The method of electrowinning metal from an aqueous electrolyte solution contaning ions of the metal to be won which comprises passing an electrolysis current between a dimensionally stable anode and a cathode on which the metal to be won is to be deposited and maintaining the anode surface at which oxygen is evolved at a temperature below 40° C to prevent deposition on of an impurity on the anode which increases oxygen overvoltage and causes passivation.

8. The method of claim 7 in which the anode comprises a film forming base metal from the group consisting of aluminum, tantalum and titanium having an electrocatalytic coating thereon containing a platinum group metal oxide.

9. The method of claim 7 in which the electrocatalytic coating contains a mixture of a platinum group metal oxide and an oxide of a film forming metal.

10. The method of electrowinning metal from an aqueous electrolyte solution containing ions of the metal to be won, using a hollow dimensionally stable anode and a cathode which the metal is deposited which comprises cooling the anode surface at which oxygen is evolved below the temperature of the electrolyte contained in the cell by circulating a cooling fluid inside the hollow anode structure and passing the said fluid in a closed circuit whereby the heat drawn from the anode structure preheats the electrolyte solution before it is introduced into the electrolytic cell whereby deposition of an impurity on the anode which increases oxygen overvoltage and causes passivation is avoided.

11. In the electrowinning of metals from acid aqueous solutions of the metals to be won by passing an electric current through the said solution which contains at least one metal of the group consisting of iron, cobalt and manganese as an impurity to deposit the electrowinned metal at the cathode and to evolve oxygen at the anode, the improvement comprising operating the electrolysis so that the surface of the anode is not greater than 40° C to substantially prevent deposition of oxides of the metal impurities on the anode surface.

12. The method of claim 11 wherein the temperature of the anode surface is below 20° C.

13. The method of claim 12 wherein the temperature of the anode surface is 4° to 18° C.

14. The method of claim 11 wherein the metals electrowinned are selected from the group consisting of copper, zinc, nickel and cobalt.

* * * * *